US012495917B1

(12) United States Patent
Xie

(10) Patent No.: US 12,495,917 B1
(45) Date of Patent: Dec. 16, 2025

(54) MIRROR

(71) Applicant: Sijia Xie, Guangdong Province (CN)

(72) Inventor: Sijia Xie, Guangdong Province (CN)

( * ) Notice: Subject to any disclaimer, the term of this patent is extended or adjusted under 35 U.S.C. 154(b) by 0 days.

(21) Appl. No.: 19/097,810

(22) Filed: Apr. 1, 2025

(51) Int. Cl.
*A47G 1/24* (2006.01)

(52) U.S. Cl.
CPC ..... *A47G 1/24* (2013.01)

(58) Field of Classification Search
CPC ..... A47G 1/24; A45D 42/12; A45D 42/16; A45D 42/08; F16L 3/1016; F16L 3/1025; F16L 3/1091; F16B 5/0664
USPC ..... 248/476, 477, 160, 479, 224.8; 359/880, 359/871, 872, 879, 850
See application file for complete search history.

(56) References Cited

U.S. PATENT DOCUMENTS 439,001 A * 10/1890 Greenwood ..... B60R 1/12 359/879
2,071,243 A * 2/1937 Tripp ..... A45D 42/12 224/265
2,117,403 A * 5/1938 Crosby ..... A45D 42/12 359/880
2,266,977 A * 12/1941 Lynch ..... A45D 42/12 248/472
2,277,241 A * 3/1942 Lynch ..... A45D 42/12 224/247
2,327,096 A * 8/1943 Dann ..... A45D 42/12 359/880
2,583,803 A * 1/1952 Amer ..... A45D 42/12 224/265
D362,740 S * 9/1995 Waters ..... D28/64.1
5,810,306 A * 9/1998 Hung ..... B25J 1/02 362/419
6,099,133 A * 8/2000 Wright ..... F16M 11/10 359/879
6,305,809 B1 * 10/2001 Zadro ..... G02B 5/10 359/872
6,682,198 B2 * 1/2004 Mangano ..... A45D 42/16 248/492
6,955,329 B1 * 10/2005 Shieh ..... A47G 1/24 248/475.1
7,651,229 B1 * 1/2010 Rimback ..... A45D 42/16 359/872
D639,077 S * 6/2011 DeBretton Gordon ..... D6/310
D641,769 S * 7/2011 Gaedtke ..... D16/130
9,347,660 B1 * 5/2016 Zadro ..... A45D 42/08
D996,488 S * 8/2023 Zhu ..... D16/135
D1,033,062 S * 7/2024 Liu ..... D6/310
D1,044,902 S * 10/2024 Huang ..... D16/135

* cited by examiner

*Primary Examiner* — Ingrid M Weinhold

(57) ABSTRACT

A mirror includes a main body and a bracket component. The main body is connected to the bracket component. The main body includes a panel and a frame. The panel is capable of reflecting light. The panel is installed on the frame. The bracket component includes at least one bendable and shapeable support bracket for fixing the mirror to an external object. The support bracket is capable of being bent into a variety of forms to allow the mirror to be hung or placed on the external object. Moreover, the support bracket is bendable, and the mirror can be adjusted and fixed at various angles.

17 Claims, 6 Drawing Sheets

MIRROR

TECHNICAL FIELD

The present invention relates to the field of mirrors, particularly to a mirror.

BACKGROUND ART

Mirrors are indispensable daily necessities in people's lives. However, most mirrors on the market have a relatively single usage method. They can only be placed on a desktop, hung on a wall, or held by hand, and cannot provide more convenience for users during use. Users need a mirror that can be placed and hung at will. Therefore, the present invention provides a mirror that can effectively solve the above-mentioned problems.

SUMMARY

To overcome the shortcomings of the prior art, the technical solution employed in the present invention is as follows.

A mirror includes a main body and a bracket component. The main body is connected to the bracket component. The main body includes a panel and a frame. The panel is capable of reflecting light. The panel is installed on the frame. The bracket component includes at least one bendable and shapeable support bracket for fixing the mirror to an external object.

Furthermore, the bracket component further includes an installation bracket. The support bracket is detachably connected to the installation bracket.

Furthermore, the support bracket includes a bendable hollow tube body and at least one connecting member. The connecting member is arranged at an end of the tube body. The connecting member is detachably connected to the installation bracket.

Furthermore, a first through hole is defined in the connecting member. A second through hole is defined in the installation bracket. The installation bracket further includes first shaft bodies. The first through hole and the second through hole are connected through the first shaft body.

Furthermore, the support bracket further includes a bendable and shapeable metal wire. The metal wire is arranged inside the tube body.

Furthermore, the support bracket further includes a flexible protective sleeve. The flexible protective sleeve is arranged outside the tube body.

Furthermore, the installation bracket is U-shaped.

Furthermore, the frame includes a first connecting frame and a second connecting frame. The first connecting frame and the second connecting frame are detachably connected.

Furthermore, the first connecting frame and the second connecting frame are both semi-circular.

Furthermore, the first connecting frame and the second connecting frame have an identical size.

Furthermore, the first connecting frame includes a first side wall and a first side edge. The first side edge is connected to two sides of the first side wall. One end of the first side wall is provided with a first insertion portion. A first connecting hole is defined in the first insertion portion. A second connecting hole is defined in an opposite end of the first side wall. The second connecting frame includes a second side wall and a second side edge. The second side edge is connected to two sides of the second side wall. One end of the second side wall is provided with a second insertion portion. A third connecting hole is defined in the second insertion portion. A fourth connecting hole is defined in an opposite end of the second side wall.

Furthermore, a width of the first insertion portion is not greater than a width of the first side wall.

Furthermore, a width of the second insertion portion is not greater than a width of the second side wall.

Furthermore, a fifth connecting hole and a sixth connecting hole are respectively defined in two ends of the installation bracket. The installation bracket further includes second shaft bodies. When the first connecting frame is installed on the second connecting frame, the first insertion portion is inserted into a position between the second side wall and the second side edge, the first connecting hole is aligned with the fourth connecting hole, the second insertion portion is inserted into a position between the first side wall and the first side edge, and the third connecting hole is aligned with the second connecting hole. One of the second shaft bodies is inserted into the fifth connecting hole, the first connecting hole, and the fourth connecting hole, and another one of the second shaft bodies is inserted into the sixth connecting hole, the third connecting hole, and the second connecting hole, so that the installation bracket is detachably connected to the frame.

Furthermore, the frame is rotatable around the second shaft body.

Furthermore, the frame further includes an installation member. The installation member is arranged at a connection area between the first connecting frame and the second connecting frame.

Furthermore, the installation member includes a third side wall and a third side edge. A width of the third side wall is not less than a width of the first connecting frame and a width of the second connecting frame. A width of the third side edge is not less than a width of the first side edge and a width of the second side edge. A seventh connecting hole is defined in the third side wall.

Furthermore, the bracket component further includes a sponge sleeve. The sponge sleeve wraps around the support bracket.

Furthermore, the panel includes a first mirror surface and a second mirror surface.

Furthermore, the main body further includes a filling block. The filling block is arranged between the first mirror surface and the second mirror surface.

Beneficial effects of the present invention are as follows. The present invention discloses the mirror. The main body is connected to the bracket component. The main body is equipped with mirror surfaces. The bracket component includes at least one bendable and shapeable support bracket. The support bracket is capable of being bent into a variety of forms, so that the mirror can be hung or placed on the external object. Moreover, the support bracket is bendable, and the mirror can be adjusted and fixed at various angles, making it convenient for a user to use in various scenarios and bringing more convenience to the user.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
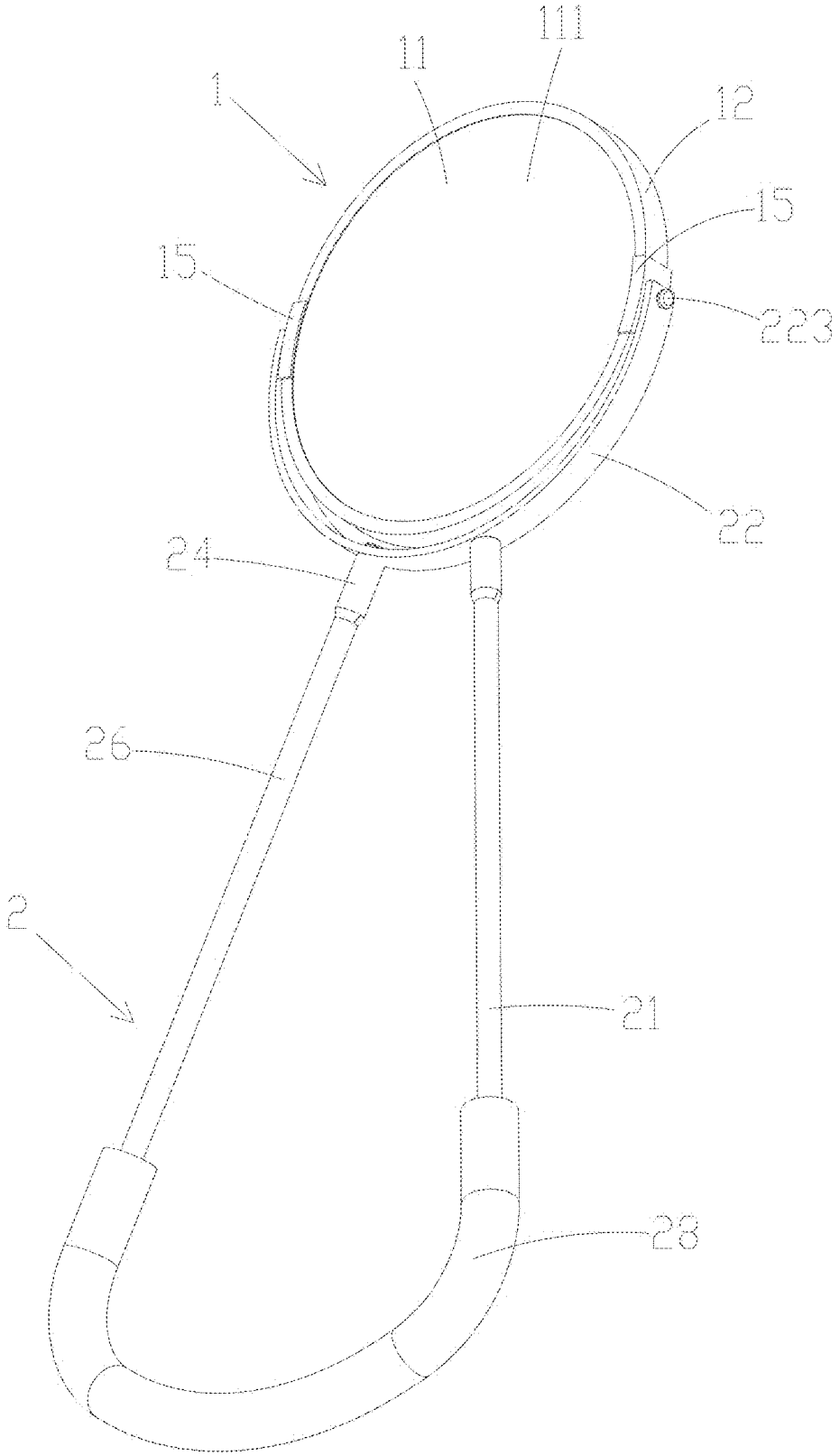
FIG. 1 is a perspective view of a mirror.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
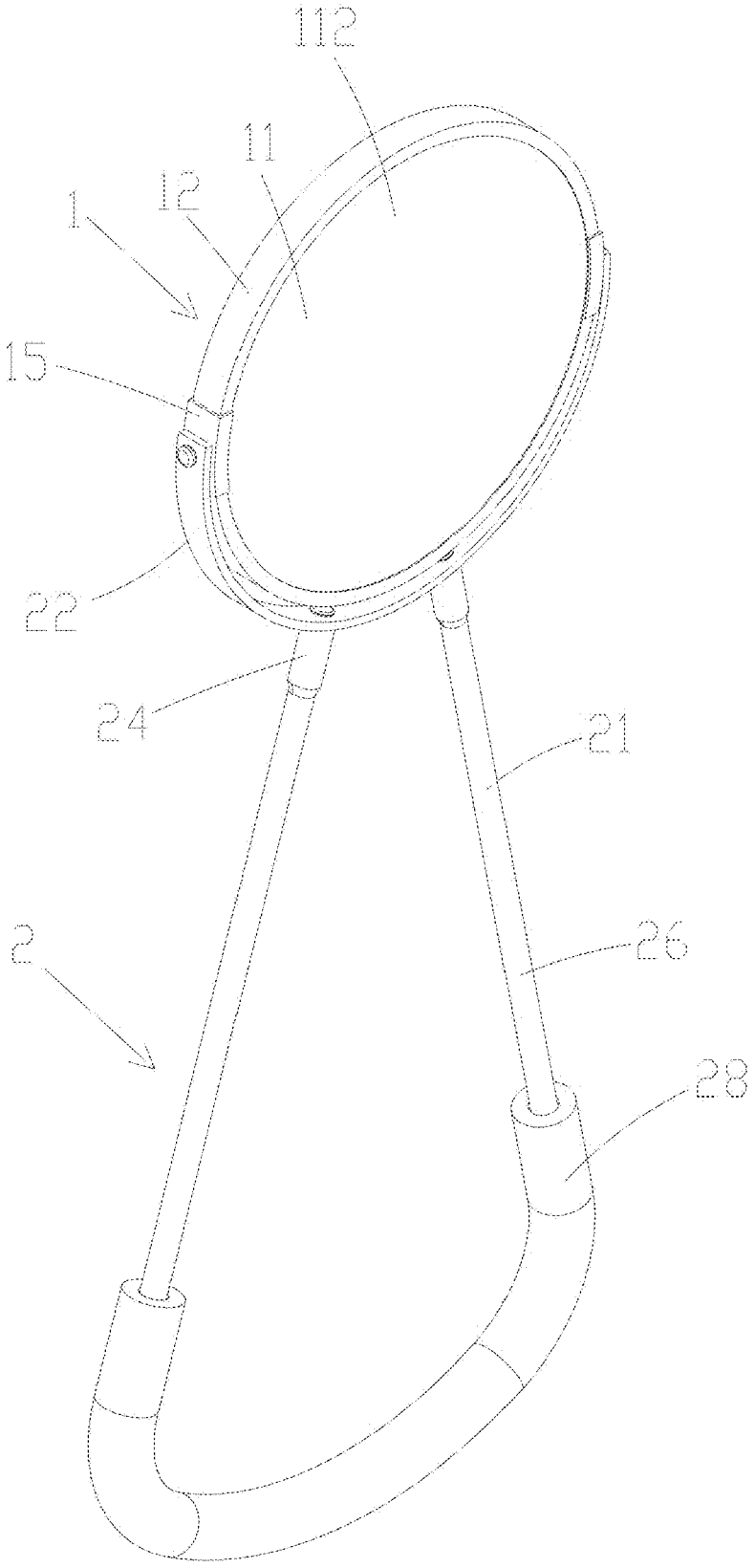
FIG. 2 is a perspective view of a mirror from another angle of view.
Figure 3:
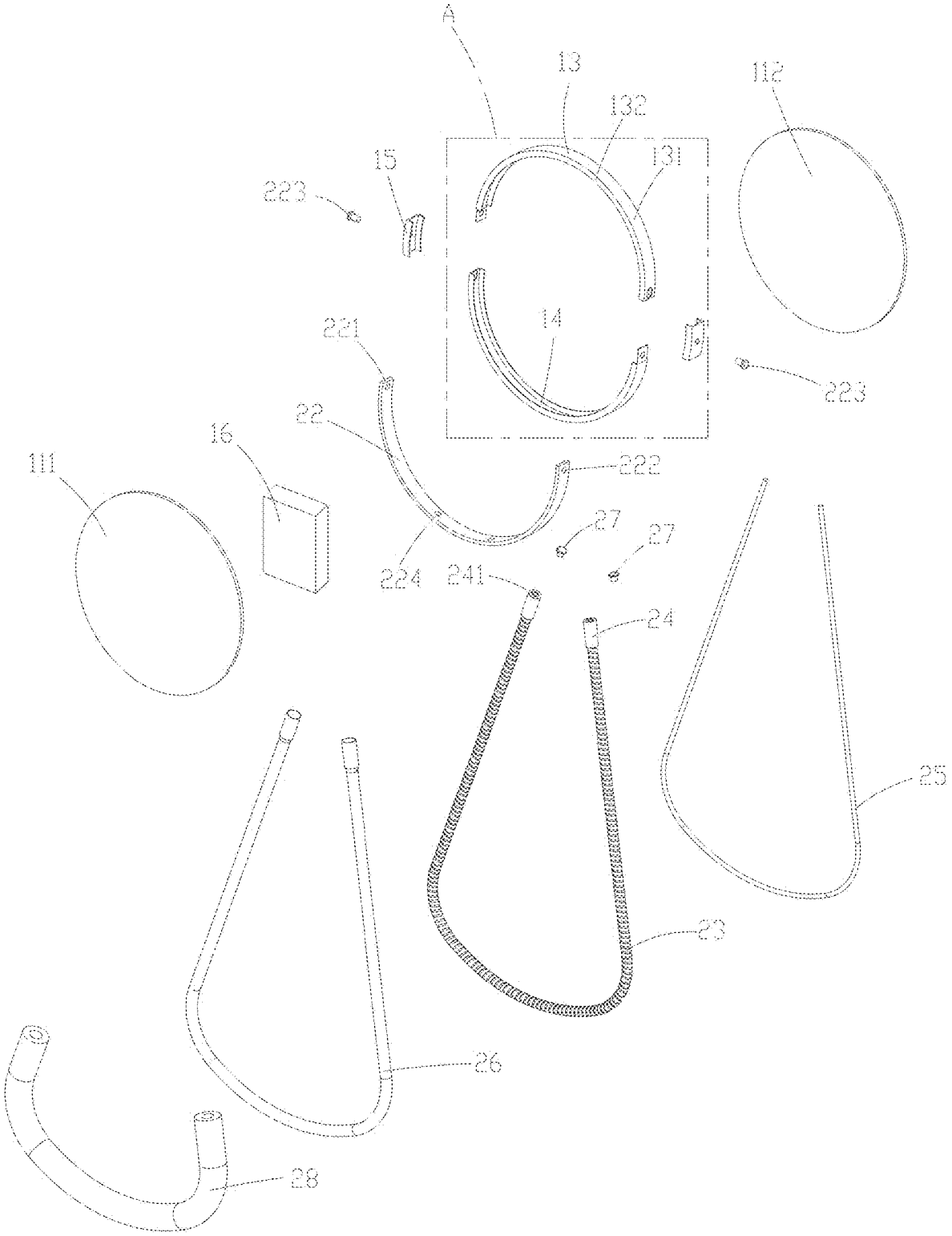
FIG. 3 is an exploded view of a mirror.
Figure 4:
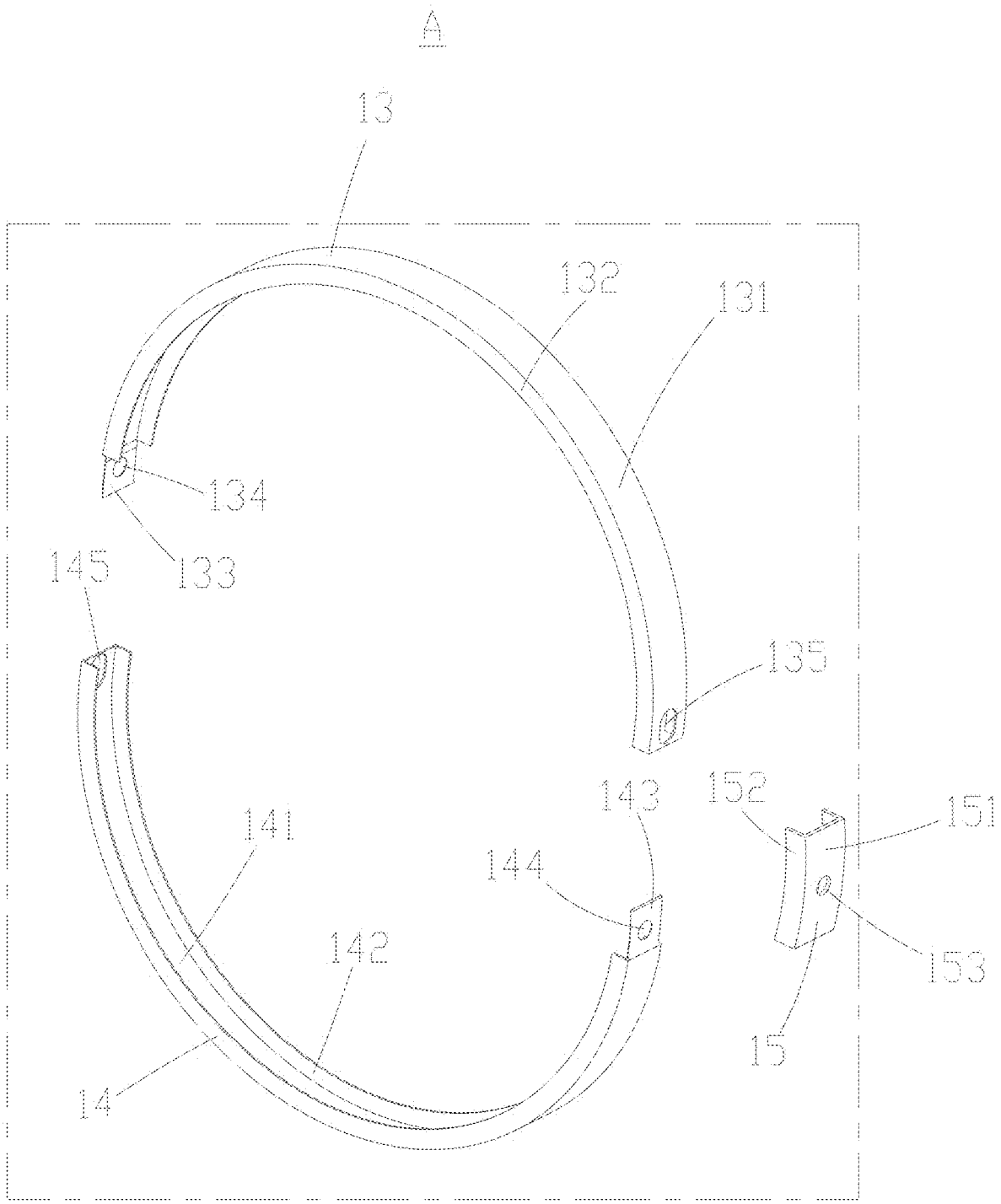
FIG. 4 is an enlarged view of area A in FIG. 3.
Figure 5:
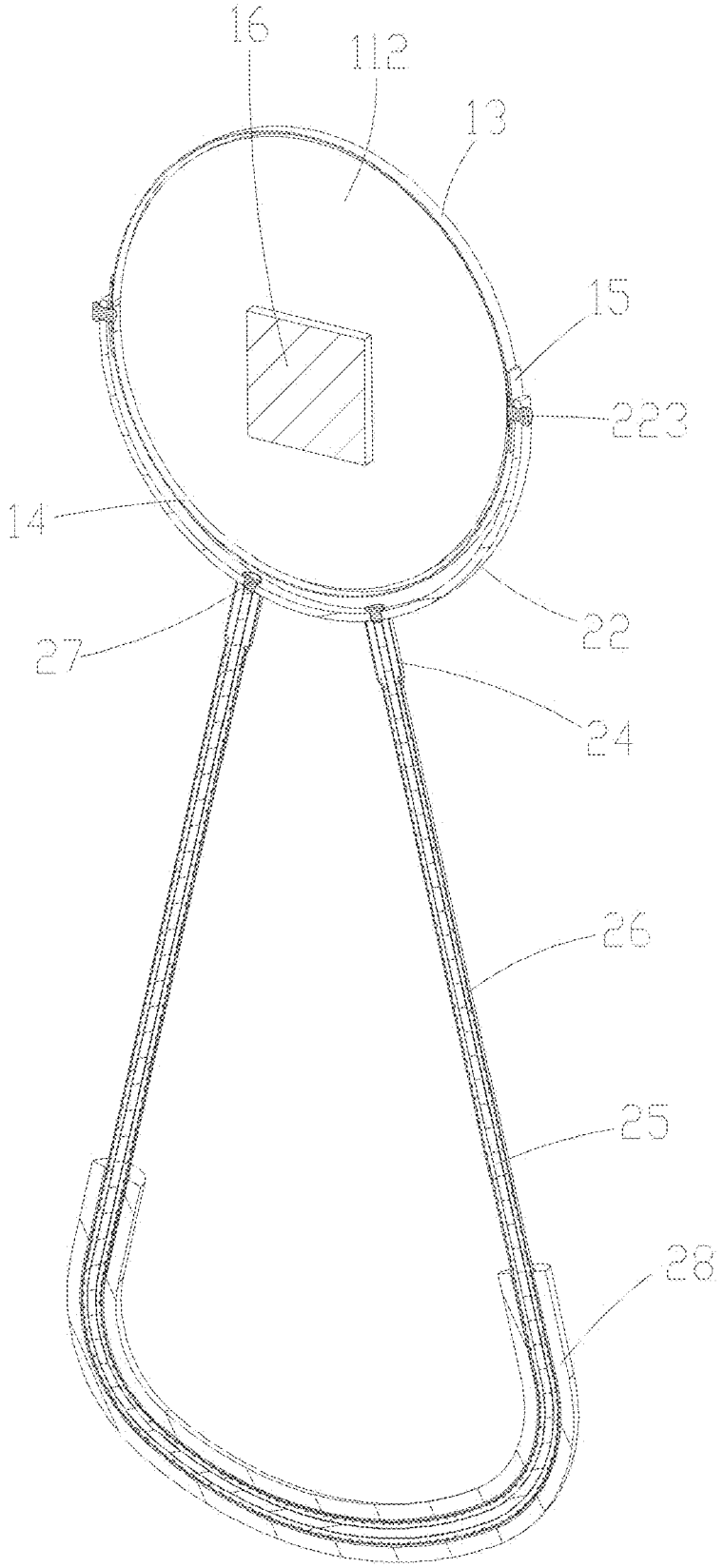
FIG. 5 is a sectional view of a mirror.
Figure 6:
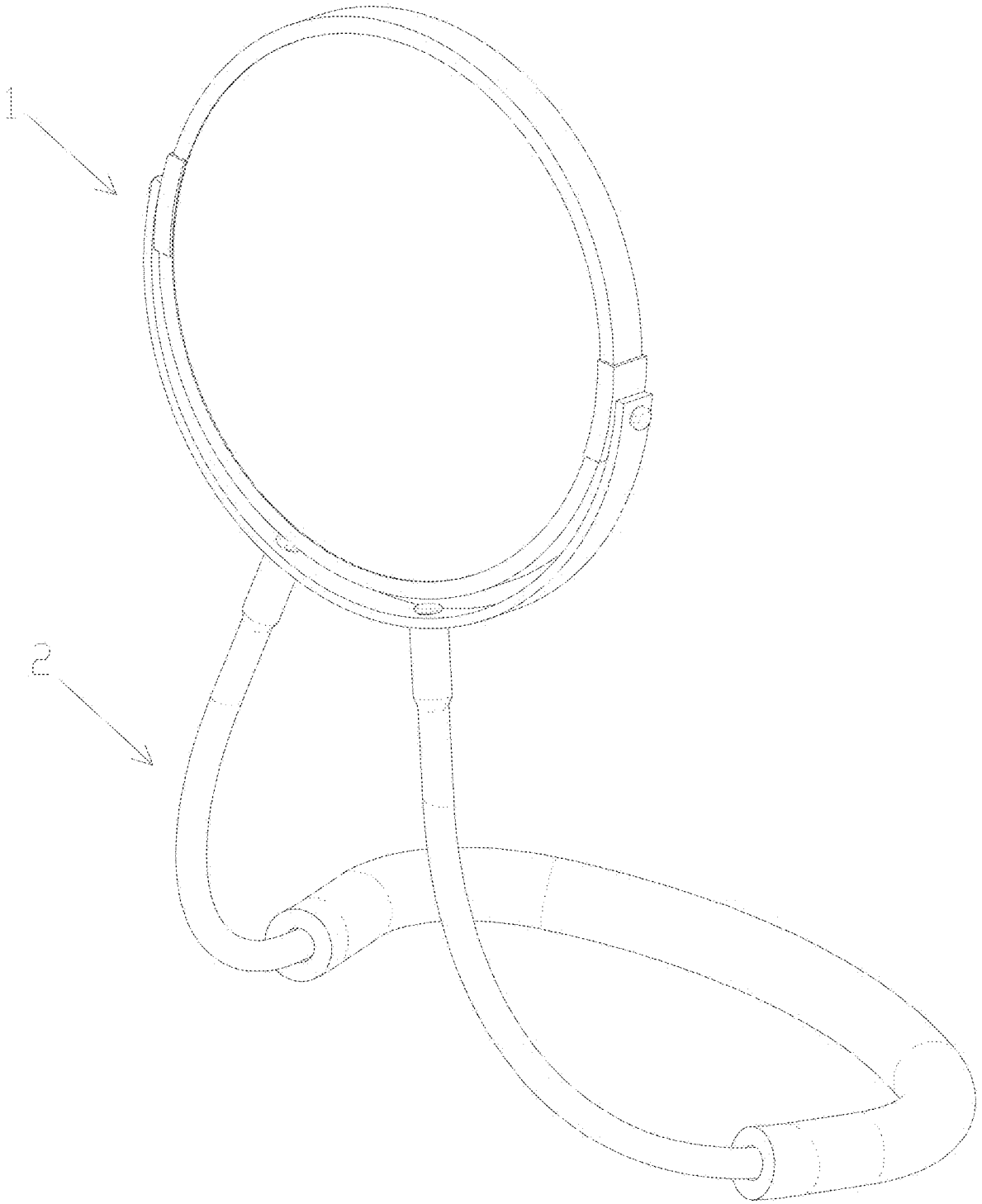
FIG. 6 is a schematic diagram of a usage state of a mirror.

Referring to FIGS. 1-6, the present invention provides a mirror. The mirror includes a main body 1 and a bracket component 2. The main body 1 is connected to the bracket component. The main body 1 includes a panel 11 and a frame 12. The panel 11 is capable of reflecting light. The panel 11 is installed on the frame 12. The bracket component 2 includes at least one bendable and shapeable support bracket 21 for fixing the mirror to an external object.

Through the arrangement of the above structure, the main body 1 is connected to the bracket component 2, the bracket component 2 includes at least one bendable and shapeable support bracket 21, and the support bracket 21 is capable of being bent into a variety of forms, so that the mirror can be hung or placed on the external object (for example, hung on a neck, hung on a clothes hanger, placed on a desktop, placed on a bed, held by a hand, etc.). Moreover, the support bracket is bendable, and the mirror can be adjusted and fixed at various angles, making it convenient for a user to use in various scenarios and bringing more convenience to the user.

In this embodiment, the support bracket 21 includes one bendable and shapeable metal wire 25, one bendable hollow tube body 23, one flexible protective sleeve 26, and a sponge sleeve 28. The tube body 23 is sleeved on an outer portion of the metal wire 25 to protect the metal wire 25. At the same time, the metal wire 25 is bendable and shapeable at will, and the tube body 23 is also bendable. After the metal wire 25 is bent and shaped, the tube body 23 can maintain an identical bent shape with the metal wire 25. Preferably, the tube body 23 is a corrugated tube made of metal material, which can effectively protect the metal wire 25 from damage. The flexible protective sleeve 26 is sleeved on an outer portion of the tube body 23, which can provide protection for the tube body 23, and also enhance the user's tactile experience when holding a part of the tube body 23, without the cold and abrasive feel of a metal corrugated tube. The sponge sleeve 28 is sleeved on an outer portion of the flexible protective sleeve 26. The material of the sponge sleeve 28 is relatively soft and elastic. If the user hangs the mirror around the neck, the sponge sleeve 28 can bring a more comfortable feeling to the user. At the same time, the sponge sleeve 28 also has a certain anti-slip performance. When the mirror is placed on a desktop, a friction force between the mirror and the desktop can be increased, and the desktop can also be protected from scratches caused by the support bracket 21.

In this embodiment, the bracket component 2 further includes an installation bracket 22. The installation bracket 22 includes first shaft bodies 27. An end portion of the tube body 23 is equipped with a connecting member 24. A first through hole 241 is defined in the connecting member 24. A second through hole 224 is defined in the installation bracket 22. The first shaft body 27 is inserted into the second through hole 224 and the first through hole 241, so that the installation bracket 22 and the support bracket 21 are detachably connected. Preferably, the first shaft body 27 is a screw, and the first through hole 241 is internally provided with threads, making it convenient for the user to quickly disassemble or install the installation bracket 22 and the support bracket 21 using tools.

In this embodiment, the panel 11 is detachably installed on the frame 12. The panel 11 includes a first mirror surface 111 and a second mirror surface 112. The first mirror surface 111 and the second mirror surface 112 can be different types of mirror surfaces. For example, the first mirror surface 111 is a common mirror surface, the second mirror surface 112 is a distorting mirror. The combination of multiple types of mirrors can increase the user's interest.

In this embodiment, the frame 12 includes a first connecting frame 13 and a second connecting frame 14. The first connecting frame 13 and the second connecting frame 14 have an identical size. The first connecting frame 13 and the second connecting frame 14 are both semi-circular. The first connecting frame 13 and the second connecting frame 14 are spliced together to form the circular frame 12. The first connecting frame 13 includes a first side wall 131 and two spaced first flanges 132. The first flanges 132 are connected on opposite sides of the first side wall 131. The second connecting frame 14 includes a second side wall 141 and two spaced second flanges 142. The second flanges 142 are connected to two opposite sides of the second side wall 141. When the first connecting frame 13 and the second connecting frame 14 are spliced together, the first mirror surface 111 and the second mirror surface 112 can be installed inside the frame 12. The first flanges 132 and the second flanges 142 can prevent the first mirror surface 111 and the second mirror surface 112 from falling off from the frame 12. A filling block 16 is arranged between the first mirror surface 111 and the second mirror surface 112. Preferably, the filling block 16 is made of sponge material. The filling block 16 can make the first mirror surface 111 and the second mirror surface 112 tightly press against the first flanges 132 and the second flanges 142, thereby reducing the shaking of the first mirror surface 111 and the second mirror surface 112. At the same time, the filling block 16 can also play a shockproof role, making the first mirror surface 111 and the second mirror surface 112 less prone to breakage.

In this embodiment, one end of the first side wall 131 is provided with a first insertion portion 133. A width of the first insertion portion 133 is not greater than a width of the first side wall 131. A first connecting hole 134 is defined in the first insertion portion 133. A second connecting hole 135 is defined in an opposite end of the first side wall 131. One end of the second side wall 141 is provided with a second insertion portion 143. A width of the second insertion portion 143 is not greater than a width of the second side wall 141. A third connecting hole 144 is defined in the second insertion portion 143. A fourth connecting hole 145 is defined in an opposite end of the second side wall 141. During installation, the first insertion portion 133 is inserted into a position between the second flanges 142 and the second side wall 141, and the first connecting hole 134 is aligned with the fourth connecting hole 145. The second insertion portion 143 is inserted into a position between the first side wall 131 and the first flanges 132, and the third connecting hole 144 is aligned with the second connecting hole 135. The installation bracket 22 also includes second shaft bodies 223. A fifth connecting hole 221 and a sixth connecting hole 222 are respectively defined in two ends of the installation bracket 22. One of the second shaft bodies 223 is inserted into the fifth connecting hole 221, the first connecting hole 134, and the fourth connecting hole 145, and another one of the second shaft bodies 223 is inserted into the sixth connecting hole 222, the third connecting hole 144, and the second connecting hole 135, so that the installation bracket 22 is rotatably connected to the main body 1. The main body 1 is rotatable around the second shaft body 223, which is convenient for the user to adjust.

In this embodiment, the frame 12 further includes an installation member 15. The installation member 15 includes a third side wall 151 and two spaced third flanges 152. The third flanges 152 are connected to two opposite sides of the third side wall 151. A width of the third side wall 151 is not less than a width of the first connecting frame 13 and a width of the second connecting frame 14. A width of each third flange 152 is not less than a width of each first flange 132 and a width of each second flange 142. The installation member 15 is in a circular arc shape. A seventh connecting hole 153 is defined in the third side wall 151. The installation member 15 is installed at a connection area between the first connecting frame 13 and the second connecting frame 14. The third side wall 151 exactly fits the first side wall 131 and the second side wall 141. The third flanges 152 exactly fit the first flanges 132 and the second flanges 142. The seventh connecting hole 153 is aligned with the third connecting hole 144, the second connecting hole 135, the first connecting hole 134, and the fourth connecting hole 145, so that the second shaft body 223 is inserted therein. The installation member 15 is capable of covering a seam at the connection area between the first connecting frame 13 and the second connecting frame 14, thereby improving aesthetics. Moreover, the installation member 15 can make the connection between the first connecting frame 13 and the second connecting frame 14 more secure.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A mirror, comprising:

a main body; and a bracket component;

wherein the main body is connected to the bracket component; the main body comprises a panel and a frame; the panel is capable of reflecting light; the panel is installed on the frame; and the bracket component comprises at least one bendable and shapeable support bracket for fixing the mirror to an external object;

wherein the bracket component further comprises an installation bracket; and the support bracket is detachably connected to the installation bracket;

wherein the frame comprises a first connecting frame and a second connecting frame; and the first connecting frame and the second connecting frame are detachably connected;

wherein the first connecting frame comprises a first side wall and two spaced first flanges; the first flanges are connected on two opposite sides of the first side wall; one end of the first side wall is provided with a first insertion portion; a first connecting hole is defined in the first insertion portion; a second connecting hole is defined in an opposite end of the first side wall; the second connecting frame comprises a second side wall and two spaced second flanges; the two second flanges are connected on two opposite sides of the second side wall; one end of the second side wall is provided with a second insertion portion; a third connecting hole is defined in the second insertion portion; and a fourth connecting hole is defined in an opposite end of the second side wall.

2. The mirror according to claim 1, wherein the support bracket comprises a bendable hollow tube body and at least one connecting member; the connecting member is arranged at an end of the tube body; and the connecting member is detachably connected to the installation bracket.

3. The mirror according to claim 2, wherein a first through hole is defined in the connecting member; a second through hole is defined in the installation bracket; the installation bracket further comprises a first shaft body; and the first through hole and the second through hole are connected through the first shaft body.

4. The mirror according to claim 2, wherein the support bracket further comprises a bendable and shapeable metal wire; and the metal wire is arranged inside the tube body.

5. The mirror according to claim 2, wherein the support bracket further comprises a flexible protective sleeve; and the flexible protective sleeve is arranged outside the tube body.

6. The mirror according to claim 1, wherein the installation bracket is U-shaped.

7. The mirror according to claim 1, wherein the first connecting frame and the second connecting frame are both semi-circular.

8. The mirror according to claim 1, wherein the first connecting frame and the second connecting frame have an identical size.

9. The mirror according to claim 1, wherein a width of the first insertion portion is not greater than a width of the first side wall.

10. The mirror according to claim 1, wherein a width of the second insertion portion is not greater than a width of the second side wall.

11. The mirror according to claim 1, wherein a fifth connecting hole and a sixth connecting hole are respectively defined in two ends of the installation bracket; the installation bracket further comprises second shaft bodies; when the first connecting frame is installed on the second connecting frame, the first insertion portion is inserted into a position between the second side wall and the second flanges, the first connecting hole is aligned with the fourth connecting hole, the second insertion portion is inserted into a position between the first side wall and the first flanges, and the third connecting hole is aligned with the second connecting hole; one of the second shaft bodies is inserted into the fifth connecting hole, the first connecting hole, and the fourth connecting hole, and another one of the second shaft bodies is inserted into the sixth connecting hole, the third connecting hole, and the second connecting hole, so that the installation bracket is detachably connected to the frame.

12. The mirror according to claim 11, wherein the frame is rotatable around the second shaft bodies.

13. The mirror according to claim 1, wherein the frame further comprises an installation member; and the installation member is arranged at a connection area between the first connecting frame and the second connecting frame.

14. The mirror according to claim 13, wherein the installation member comprises a third side wall and two spaced third flanges; the two third flanges are connected on two opposite sides of the third side wall; a width of the third side wall is not less than a width of the first connecting frame and a width of the second connecting frame; a width of each third flange is not less than a width of each first flange and a width of each second flange; and a seventh connecting hole is defined in the third side wall.

15. The mirror according to claim 1, wherein the bracket component further comprises a sponge sleeve; and the sponge sleeve wraps around the support bracket.

16. The mirror according to claim 1, wherein the panel comprises a first mirror surface and a second mirror surface.

17. The mirror according to claim 16, wherein the main body further comprises a filling block; and the filling block is arranged between the first mirror surface and the second mirror surface.

* * * * *